United States Patent [19]

Middelbeek

[11] 4,059,526

[45] Nov. 22, 1977

[54] DEVICE FOR COLLECTING LIGHT-WEIGHT SUBSTANCES FLOATING ON A LIQUID SURFACE

[75] Inventor: Cornelis Gerardus Middelbeek, Nootdorp, Netherlands

[73] Assignee: Ballast Nedam Groep N.V., Amstelveen, Netherlands

[21] Appl. No.: 669,834

[22] Filed: Mar. 24, 1976

[30] Foreign Application Priority Data

Apr. 4, 1975 Netherlands ..... 7504064

[51] Int. Cl.[2] ..... E02B 15/04

[52] U.S. Cl. ..... 210/242 S; 210/DIG. 25

[58] Field of Search ..... 210/89, 169, 207, 242 R, 210/242 A, 242 S, 258, 538, 540, DIG. 25

[56] References Cited

U.S. PATENT DOCUMENTS

| | | | |
|---|---|---|---|
| 3,756,578 | 9/1973 | McGurk | 210/242 A |
| 3,789,589 | 2/1974 | Arnold et al. | 210/DIG. 25 |
| 3,890,234 | 6/1975 | Galicia | 210/DIG. 25 |
| 3,962,093 | 6/1976 | Gibson | 210/242 S |

*Primary Examiner*—Theodore A. Granger
*Attorney, Agent, or Firm*—Snyder, Brown & Ramik

[57] ABSTRACT

In an apparatus for collecting light-weight substance floating on a liquid the light-weight substance is sprayed with the aid of a liquid jet into an accumulator tank in that the light-weight substance lands together with the liquid jet as a downward stream about a lower edge of the open bottom of the tank into said tank.

In order to keep the liquid jet effective the disintegration of the liquid jet is prevented. To this end the liquid jet is guided above the layer of light-weight substance along a bar or similar guide means.

9 Claims, 6 Drawing Figures

FIG. 1
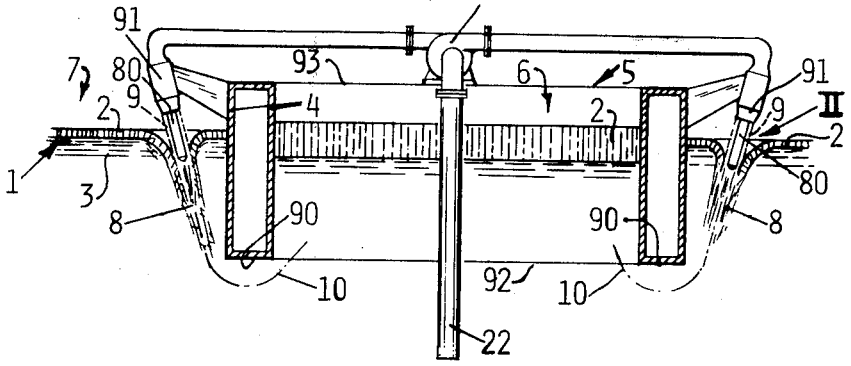
FIG. 2
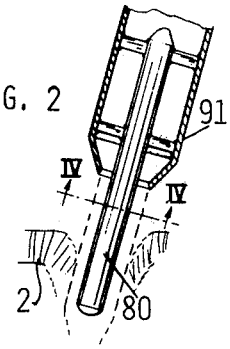
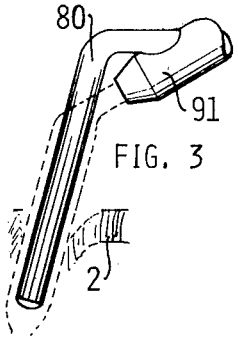
FIG. 3
FIG. 6
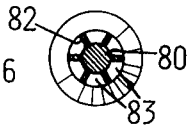
FIG. 4
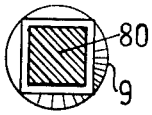
FIG. 5
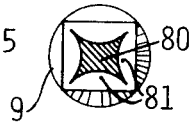

DEVICE FOR COLLECTING LIGHT-WEIGHT SUBSTANCES FLOATING ON A LIQUID SURFACE

The invention relates to an apparatus for collecting at least one light-weight substance floating on a liquid, for example, oil floating on water, said light-weight substance being conducted into an accumulator tank, at least one of the downwardly extending walls of which extends as far as below the liquid surface, in which at least on the outer side of the immersed wall away from the liquid surface at least one downward stream is produced, with which the light-weight substance together with liquid is directed from a portion of the liquid surface located outwardly of the upright wall towards a region just below the lower edge of the immersed wall and conducted into the interior of the accumulator tank, where the light-weight substances rise up to the liquid surface and are collected in situ, whilst liquid is conducted away through at least one outlet near the bottom side of the accumulator tank.

The liquid jet is effective if it covers a short path above the light-weight substance. In the event of a long path, even a path of more than 5 cms the jet will already be spread. The longer the jet the less effective it becomes. Particularly when the liquid jet is directed at a rake angle to light-weight substance, it disintegrates in a fan-shaped fashion.

The invention has for its object to improve the effect of the liquid jet. According to the invention the fluid jet is held from above the level of the light-weight substance towards the outer side of and at a distance from the downwardly extending wall and guided by guide means extending into the liquid.

The jet adheres to the outer side of the guide means so that the outer surface of the jet is more tightly closed. The fluid jet remains satisfactorily united even when it is inclined towards the light-weight substance. In the event of wind the risk of disintegration of the fluid jet is small.

The invention relates to and provides furthermore a device for collecting at least one light-weight substance floating on a liquid, for example, oil floating on water, comprising at least one accumulator tank for the light-weight substance to be collected, at least one downwardly extending wall of which extends as far as into the liquid and a jet nozzle for producing at least one downward stream directed away from a portion of the liquid surface located at a distance from the outer side of the downwardly extending wall, with which stream the light-weight substance is conducted past beneath an edge of the wall beneath the liquid surface into the accumulator tank, said device being characterized by guide means connected by their top ends with jet nozzle, extending beyond the jet nozzle inside the jet and extending by their lower ends into the liquid, guiding the fluid jet above the light-weight substance along their outer sides, and being arranged at a distance from the downwardly extending wall.

If the guide means are formed by at least one bar, a layer of light-weight substance can be assembled in the fluid jet with the aid of a smaller quantity of liquid.

The adhering effect of the bar is improved when it has an angular profile. Further improvement of the adhering effect of the bar is obtained by a profile having hollow surfaces and/or by providing the bar on its outer side with ridges.

The bar extends preferably coaxially with the jet nozzle.

The invention will be described more fully hereinafter with reference to the drawing.

In the drawing the following Figures show schematically by way of example:

FIG. 1 a vertical sectional view of a preferred embodiment of a device in accordance with the invention, FIG. 2 on an enlarged scale a detail II of FIG. 1, FIG. 3 a variant of the part of FIG. 2, and FIGS. 4, 5 and 6 each an example of a section IV—IV in FIG. 2.

The Figures illustrate schematically that a polluting, light-weight substance 2 is floating on a liquid surface 1. Hollow walls 4 of an accumulator tank 5 inserted into the liquid 3 separate the collecting space 6 from the outer space 7.

The polluting substance 2 may be foam, vegetable refuce, sawdust or a similar solid substance and/or crude or light oil floating, for example, on water.

Referring to FIG. 1, a downward stream 8 is produced at various places by causing at least one fluid jet 9 from a jet nozzle 91 to act in a given direction and with adequate energy upon the liquid surface 1 and the pollutions 2 floating thereon in order to ensure that in accordance with viscosity and specific weight the pollutions 2 to be carried along by each fluid jet 9 are conducted at least essentially past beneath an edge 90 of a wall 4 into the accumulator tank 5, where the light-weight substance 2 builds up a rising stream 10 flowing into the collecting space 6.

The liquid 3 carried along and the liquid supplanted by the pollutions 2 from the collecting space 6 can escape via the open bottom 92 of the accumulator tank 5.

The atmospheric air caught up during the injection of the fluid jet 9 also rises together with the light-weight substance 2 into the collecting space 6 and escapes via the open top end 93.

In order to prevent fanning out of the fluid jet 9 a bar 80 is arranged coaxially in the jet nozzle 91 and extends from the nozzle to a given depth below the level of the layer of light-weight substance so that the fluid covers the distance between the jet nozzle 91 and the light-weight substance 2 in the form of a jet 9 surrounding the bar 80. The bar 80, for forming the guide means for the fluid jet 9, enlarges the circumference of the fluid jet 9 so that its effectiveness is enhanced.

Referring to FIG. 3, a bar 80 is secured to the outer side of a jet nozzle 91 so that the fluid jet 9 is guided over an important part of its path towards the layer of light-weight substance 2.

The bar 80 may be round, but an angular profile, for example the square profile of FIG. 4 is preferred. Better still is a bar 80 having a profile with hollow surfaces 81, which are even more capable of retaining the fluid jet 9.

An ideal profile of the bar 80, shown in FIG. 6, has longitudinal ridges 82, between which channels 83 for the fluid are formed.

FIG. 1 shows that each jet nozzle 91 is connected with a fluid pump 21 having a suction tube 22 extending into the liquid 3.

The device embodying the invention is particularly advantageous if owing to fluctuations of the device the distance between the jet nozzle 91 and the level of the light-weight substance 2 has to be long.

What I claimed is:

1. In apparatus for collecting light-weight material such as oil, from the surface of a body of water, which comprises wall means defining an enclosure for isolating a volume of a body of water from the free surface of the water outside such isolated volume, said wall means extending from a level above said free surface to a level below the oil so as to define a reservoir space which communicates directly with the body of water beneath the reservoir space; and nozzle means outside of and spaced from said wall means for downwardly and inwardly directing a stream of water through the oil on the surface of the body of water to a location beneath the open bottom of said enclosure said nozzle means comprising at least one jet nozzle discharging water at said downward inclination to impinge said oil; the improvement which comprises:

guide means attached to said jet nozzle and extending downwardly therefrom at said inclination to terminate at a point below the level of said light-weight material, said guide means being oriented with respect to said jet nozzle such that the water discharged therefrom clings to and concentrically surrounds said guide means.

2. In apparatus as defined in claim 1 wherein said guide means is in the form of a circular bar.

3. In apparatus as defined in claim 1 wherein said guide means is in the form of a polygonal bar.

4. In apparatus as defined in claim 3 wherein the faces of said bar are concave.

5. In apparatus as defined in claim 2 including longitudinally extending ribs on said bar.

6. In apparatus as defined in claim 2 wherein said bar projects concentrically from the mouth of said jet nozzle.

7. In apparatus as defined in claim 3 wherein said bar projects concentrically from the mouth of said jet nozzle.

8. In apparatus as defined in claim 4 wherein said bar projects concentrically from the mouth of said jet nozzle.

9. In apparatus as defined in claim 7 wherein said bar projects concentrically from the mouth of said jet nozzle.

* * * * *